United States Patent [19]

Watine

[11] 4,384,404

[45] May 24, 1983

[54] HEAT-RECOVERABLE ARTICLES AND METHOD OF CONNECTING TWO ELECTRICAL CONDUCTORS

[75] Inventor: Didier J. M. M. J. Watine, Maisons Laffitte, France

[73] Assignee: Raychem Corporation, Menlo Park, Calif.

[21] Appl. No.: 128,459

[22] Filed: Mar. 10, 1980

[30] Foreign Application Priority Data

Mar. 9, 1979 [GB] United Kingdom ..... 7908460

[51] Int. Cl.[3] ..... H01R 43/04; H01R 4/02; H01R 4/70

[52] U.S. Cl. ..... 29/871; 174/84 R; 174/78; 174/DIG. 8; 29/869; 285/381; 285/DIG. 10; 403/273

[58] Field of Search ..... 174/84 R, DIG. 8, 78, 174/88 C; 156/86; 29/828, 859, 869, 871; 285/381, DIG. 10; 403/272, 273; 428/913

[56] References Cited

U.S. PATENT DOCUMENTS

| | | | |
|---|---|---|---|
| 3,086,242 | 4/1963 | Cook et al. . | |
| 3,243,211 | 3/1966 | Wetmore . | |
| 3,297,819 | 1/1967 | Wetmore . | |
| 3,312,772 | 4/1967 | Sherlock . | |
| 3,316,343 | 4/1967 | Sherlock | 174/84 R |
| 3,324,230 | 6/1967 | Sherlock . | |
| 3,379,218 | 4/1968 | Conde . | |
| 3,455,336 | 7/1969 | Ellis . | |
| 3,458,649 | 7/1969 | Channell | 174/78 X |
| 3,530,898 | 9/1970 | Wilson . | |
| 3,574,313 | 4/1971 | Tanaka . | |
| 3,770,556 | 11/1973 | Evans et al. . | |
| 3,891,490 | 6/1975 | Humphries . | |
| 3,927,233 | 12/1975 | Naidoff . | |
| 4,060,887 | 12/1977 | De Groef | 29/626 |
| 4,126,759 | 11/1978 | Brooks | 174/94 R |
| 4,237,609 | 12/1980 | Clabburn et al. | 29/859 |

FOREIGN PATENT DOCUMENTS

| | | | |
|---|---|---|---|
| 932414 | 8/1973 | Canada | 29/828 |
| 1519766 | 8/1978 | United Kingdom . | |

*Primary Examiner*—Carl E. Hall
*Assistant Examiner*—Carl J. Arbes
*Attorney, Agent, or Firm*—Douglas A. Chaikin

[57] ABSTRACT

The invention relates to an article suitable for making an electrical connection between two electrical conductors, for example an earth conductor and the outer conductor of a coaxial cable. The article comprises a first, heat-shrinkable, sleeve (1), a quantity of solder (2) positioned within the sleeve, and a second sleeve (5) an outer surface of which, together with an inner surface of the first sleeve, forms a passage for receiving the earth conductor. Stop means are provided for axial location of the earth conductor. On shrinking of the sleeve and fusing of the solder, an electrical connection can be made between an earth conductor received, in use, in the passage and the outer conductor of a coaxial cable received, in use, in the first sleeve but not in the passage.

15 Claims, 3 Drawing Figures

HEAT-RECOVERABLE ARTICLES AND METHOD OF CONNECTING TWO ELECTRICAL CONDUCTORS

The present invention relates to a heat-recoverable article suitable, for example, for making an electrical connection between two electrical conductors and to a connection method using such an article.

Many articles and methods have been proposed for covering one or more substrates and/or for joining a plurality of substrates, for example for making an electrical connection between two electrically conductive substrates. Thus, for example, U.S. Pat. No. 3,243,211 discloses articles comprising a heat-shrinkable sleeve and a quantity of fusible material positioned within the sleeve. The fusible material may be, for example, a polymeric material or an inorganic fusible material, for example solder. The fusible material may be in, for example, the form of a ring, or, for example, in the form of a solder ball which occupies the entire cross-section of the sleeve. An electrical connection between two conductors can be made, for example, by inserting the conductors in a sleeve which contains solder and heating the assembly to cause the sleeve to shrink and the solder to fuse.

A number of other specifications also describe articles which comprise a heat-shrinkable sleeve having a quantity of solder therein. Thus, for example, U.S. Pat. No. 3,324,230 described an electrical connector which comprises a terminal pin (or similar electrical conductor) provided with a quantity of solder and having a heat-recoverable sleeve firmly installed thereon, for example by shrinking one end of a heat-shrinkable sleeve into close contact with the pin. Moreover, U.S. Pat. No. 3,312,772 discloses a heat-shrinkable sleeve having a ring of solder therein and a ground lead (earth conductor) a portion of which is positioned between the solder ring and the sleeve.

While the articles referred to above have proved extremely useful in a wide variety of applications, they are not applicable in certain circumstances. Thus, for example, the connector described in U.S. Pat. No. 3,324,230 is designed to facilitate the connection of a further conductor to the terminal pin, and is not ideally suited to, for example, facilitating the connection of an earth conductor to the outer conductor (normally braid) of a coaxial cable. Furthermore, although the article referred to above and disclosed in U.S. Pat. No. 3,312,772 is designed for the latter use, there are circumstances where it is desirable for the workman installing the article to be able to insert the earth conductor in the article.

The present invention provides an article which comprises a first, heat-shrinkable, sleeve, a quantity of solder positioned within the first sleeve, a second sleeve, substantially all of which sleeve is positioned within the first sleeve, and at least part of which second sleeve is substantially infusible at the shrinkage temperature to which in use the article is heated to cause shrinking of the first sleeve and melting of the solder, a portion of the inner surface of the first sleeve and a portion of the outer surface of the second sleeve defining a passage for receiving a first substrate which passage preferably extends less than half way around the said second sleeve, and stop means, at least a portion of which is formed by at least one surface of the solder, for limiting the penetration of the first substrate into the first sleeve, the arrangement being such that when in use a first substrate is received in the passage and a first portion thereof abuts the stop means, a second portion of the first substrate is in proximity to the solder and, on fusing of the solder, the first substrate can be electrically connected by the solder to a second substrate which, in use, is received in the first sleeve but not in the passage. The said first portion of the first substrate can of course be closely adjacent to, or may comprise the same portion as, the said second portion.

In the article of the invention, the solder is so positioned that, on fusing of the solder, a first substrate received, in use, in the passage can be electrically connected by the solder to a second substrate received, in use, in the first sleeve but not in the passage. Preferably the arrangement is such that, before heating to cause shrinkage of the first sleeve and fusing of the solder, the end of the first substrate protrudes from the end of the passage nearer to the solder. Preferably at least a substantial part of the quantity of solder is positioned outside the passage. The solder is advantageously in the form of a ring, and a portion of the outer surface of the ring may if desired be spaced from the first sleeve to provide a second passage in alignment with the passage defined by the first and second sleeves. If desired, the end of the second sleeve nearer to the solder may abut the solder. The solder may, if desired or required, be associated with an appropriate amount of flux.

As indicated above, a portion of the inner surface of the first sleeve and a portion of the outer surface of the second sleeve define a passage for receiving a first substrate, for example an earth conductor. Except in the region of the passage, the outer surface of the second sleeve advantageously contacts the inner surface of the first sleeve and/or a layer, which may be continuous or discontinuous, on the said inner sleeve. A layer on the inner surface may be, for example, a layer of adhesive which maintains the second sleeve in the desired position in the first sleeve. The presence of an adhesive is not, however, essential, and the second sleeve could alternatively, or in addition, be maintained in position by, for example, partial shrinkage of the first sleeve therearound.

The passsage may if desired have a constriction therein which in use can grip a first substrate received in the passage to prevent accidental displacement of the article relative to the substrate. This may eliminate the need manually to hold the first substrate in position while the heating step is carried out. Advantageously the constriction is provided by an indentation in the first sleeve.

At least a portion of the stop means is formed by at least one surface of the solder, and at least part of the solder is advantageously positioned substantially in alignment with the passage such that an end of the first substrate protruding from the passage can abut the solder. A portion of the stop means may, however, be provided by, for example, a portion of the inner surface of the first sleeve, the appropriate shape being imparted to the first sleeve by, for example, partial preshrinkage of a portion of the sleeve around an appropriately shaped mandrel.

The first heat-shrinkable sleeve used in accordance with the invention is a sleeve at least part of which is heat-shrinkable and may comprise any material, advantageously an electrically insulating material, which may be converted to or maintained in a heat-shrinkable form. Examples of suitable materials are given in, for example, U.S. Pat. Nos. 3,086,242 and 3,297,819 and the other U.S specifications referred to in this specification. Crosslinked polymeric materials, for example crosslinked polyvinylidene fluoride, are particularly suitable. The sleeve is advantageously sufficiently transparent to enable the soldered connection made therein to be inspected. The sleeve may, for example, be extruded as such, or may be formed from a sheet of material, opposite edges of the sheet being joined in any suitable manner, for example by the use of a peroxide, by use of a contact adhesive (for example as disclosed in U.S. Pat. No. 3,770,556), or by the use of an insert comprising a thermoplastic material and a heat-activatable crosslinking agent (see for example U.S. Pat. Nos. 3,891,490 and 3,927,233 and British Pat. No. 1,512,727) to form the sleeve. If desired, the opposite edges of the sheet may be provided with means for making a connection between them (see for example U.S. Pat. Nos. 3,455,336, 3,379,218, 3,530,898 and 3,574,313). Where the sleeve is formed from a sheet of material, the sheet may if desired be shaped to hold the quantity of solder before formation of the sleeve.

The first sleeve may have any desired shape. One method by which a desired shape may be imparted comprises partial recovery of the sleeve round one or more appropriately-shaped mandrels. In one preferred embodiment of the invention, at least part of the first sleeve is substantially rectangular in cross-section. During installation, slight pressure may be applied to the shorter sides of such a sleeve to impart a substantially circular cross-section to the sleeve, the pressure being released after insertion of for example a cable in the sleeve so that the longer sides of the sleeve grip the cable in position.

The first sleeve may be open at one or both ends and may if desired be provided with a quantity of fusible material (for example fusible polymeric material) or other sealing material between the solder and the or each open end. The fusible material may act as a "dam" for the solder, preventing it from flowing out of the open end(s) of the sleeve during installation of the article and/or may enhance the environmental seal at the end(s) of the sleeve. Thus, the sleeve may force fused fusible material into close contact with a conductor received in the open end of the sleeve to provide a reliable seal. Alternatively, the sleeve and the fused fusible material could cooperate to produce a seal even at an open end that does not in use receive a substrate.

The second sleeve in the article of the invention advantageously comprises an electrically insulating material and may comprise the same material as the first sleeve, or a different material. Examples of suitable materials for the second sleeve are the materials specified in connection with the first sleeve. If the first sleeve is transparent, the second sleeve is advantageously also transparent. The whole of the length of the second sleeve is advantageously positioned in the first sleeve and, preferably, the end of the second sleeve remote from the solder is spaced from the adjacent end of the first sleeve such that a quantity, preferably a ring, of fusible material may be positioned between the end of the second sleeve and the end of the first sleeve. If, however, a suitably positioned part of the second sleeve is fusible at the temperature to which in use the article is heated to cause shrinking of the first sleeve and fusing of the solder, the said quantity of fusible material may be omitted. Advantageously, however, the second sleeve is substantially infusible at the said temperature, and, preferably the second sleeve is heat-shrinkable (that is, at least a part thereof will shrink on the application of heat). The second sleeve may be open at one or both ends.

The invention thus provides an article comprising a sleeve having at least one open end. A quantity of solder is positioned remote from the open end. A second sleeve is provided at least in the region between the open end and the solder, part of the second sleeve being spaced from the first to provide a passage for receiving an elongate article. Preferably, although the second sleeve and the solder may overlap, at least a portion of the solder is positioned further from the open end than is any part of the second sleeve. It is not essential for the guide means to extend to the open end or to the solder. Stop means, for determining the axial penetration of the elongate substrate into the sleeve are provided, at least a portion of the stop means being formed by at least one surface of the solder.

The present invention also provides a method of connecting first and second electrical conductors which comprises, in either order or substantially simultaneously, positioning the first conductor such that it is received in the passage of an article in accordance with the invention with an end thereof abutting the stop means and positioning the second conductor in the first sleeve, and then heating to cause shrinkage of the sleeve and flowing of the solder whereby an electrical connection is made between the conductors. The first conductor may be, for example, an earth conductor and the second conductor may be, for example, the outer conductor of a coaxial cable.

The article of the invention may readily be manufactured without the use of complicated tooling. Furthermore, the passage makes it possible for a first substrate, for example an earth conductor, to be positioned in the desired location within the cross-section of the first sleeve, while the stop means makes it possible to control the axial penetration of the first substrate. The first substrate may thus be reliably located, even by an unskilled workman, in relation to the solder, thus making it possible to ensure that the first substrate is in the best possible position for soldering to a second substrate received in the first sleeve. The second sleeve may act to give additional protection to, for example, cable insulation having a low temperature rating which might otherwise be adversely affected by the heat applied to cause shrinkage of the sleeve.

A further advantage of the article of the invention is that it may be shaped to grip the first and/or second substrate during the heating step so that it may not be necessary manually to hold the substrates in position during that step. Thus, as indicated earlier, the passage may have a constriction therein for gripping the first substrate, while at least part of the first sleeve may be substantially rectangular in cross-section and deformable during installation so that it can, on release of the deforming forces, grip a second substrate positioned within the sleeve. Moreover, the fact that in this embodiment at least part of the first sleeve does grip the second substrate may ensure that the sleeve is maintained in a preferred orientation in relation to the second substrate (and is preferably also so maintained during heat-recovery of the sleeve) and/or may provide means for ensuring that, for example, a further article or member is in the correct position relative to the substrate and/or to an insert within the sleeve. Thus, for example, in the case of the article of the invention wherein at least part of the sleeve has a substantially rectangular cross-section, the fact that the sleeve may, before (and preferably also during) recovery, grip a second substrate positioned in it makes it possible, if this is desired or required, to ensure that the solder is in a preferred orientation relative to the second substrate. Moreover, portions of the sleeve that, before recovery, are spaced from the second substrate may, in cooperation with the outer surface of the second substrate, define one or more compartments for locating a further substrate in a desired position, for example in relation to the second substrate and/or in relation to the solder. The fact that the sleeve and second substrate contact each other where the sleeve grips the cable may also, if the solder is appropriately positioned, assist in maintaining molten solder in a desired location during recovery of the article.

One embodiment of the invention will now be described, by way of example only, with reference to the accompanying drawings, in which.

Figure 1:
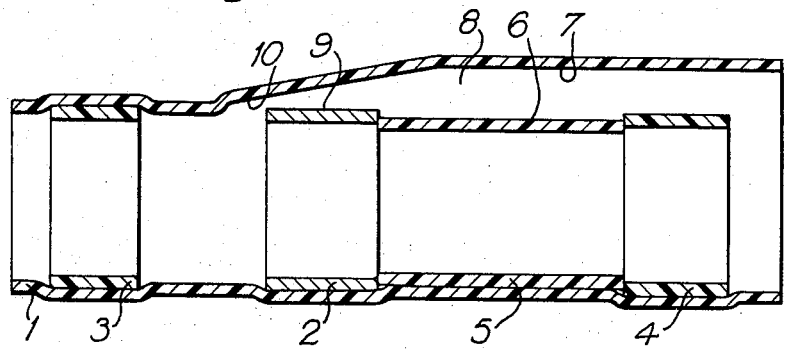
FIG. 1 is a longitudinal section through an article in accordance with the invention.
Figure 2:
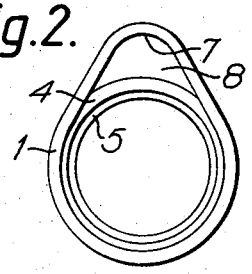
FIG. 2 is an end view of the article shown in FIG. 1.

The Figures are not drawn to scale.

Referring now to the drawings, the article shown in the drawings comprises a heat-shrinkable sleeve 1 having two open ends. A ring 2 of solder is positioned within the sleeve, and each end of the sleeve has a ring, 3 and 4 respectively, of fusible polymeric material adjacent thereto. Between the ring 4 and the solder ring 2 is positioned an inner (second) sleeve 5 which is generally cylindrical and of substantially, infusible heat-shrinkable material. Part of the outer surface of each of the solder ring 2, the ring 4 of fusible polymeric material, and the inner sleeve 5 is spaced from the inner surface of the sleeve 1 to permit the insertion of a first substrate, for example an earth conductor, between an inner surface of the sleeve 1 and the outer surface of the said components.

Figure 3:
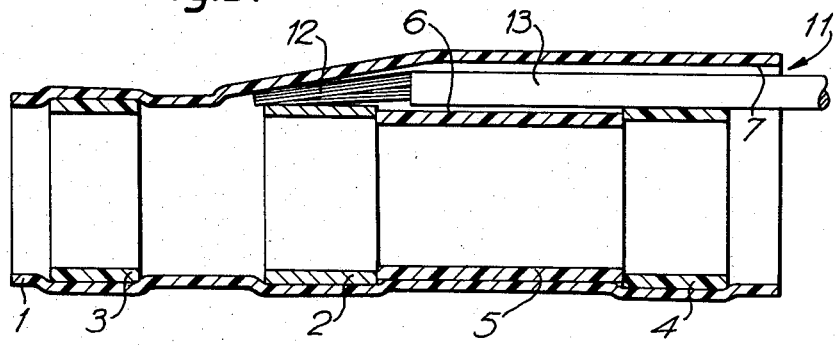
FIG. 3 shows a conductor positioned in the article of FIGS. 1 and 2.

In the article shown in the drawings, the outer surface 6 of the inner sleeve 5 and inner surface 7 of the sleeve 1 define a passage 8 for receiving a first substrate and ensuring that a portion thereof may be positioned in proximity to the solder. Axial positioning is determined by a stop provided by the outer surface 9 of the solder ring and the adjacent inner surface 10 of the sleeve 1. In an alternative embodiment (not shown) the stop could, for example, be provided solely by the solder. FIG. 3 shows an earth conductor 11 positioned within the passage 8 with an end portion 12 thereof from which the insulation 13 has been removed abutting the stop.

I claim:

1. A heat-recoverable article comprising:

a first heat-recoverable sleeve having an inner surface; a second sleeve, at least a part of which is of substantially infusible material disposed within the first sleeve, the second sleeve having an outer surface, a portion of the outer surface contacting a portion of the first sleeve inner surface, the remaining portions of the inner and outer surfaces of the first and second sleeves, respectively defining a substantially non-annular, empty first passage which is a means for guiding the insertion of a first substrate into the article;

a quantity of solder disposed within the first sleeve contacting a portion of the inner surface of the first sleeve and in the proximity of one end of second sleeve;

stop means disposed within the first sleeve, formed at least in part by the solder, for limiting penetration of the first substrate into the first passage; and the second sleeve infusible material being infusible at a temperature needed to cause the first sleeve to heat recover and the solder to melt.

2. The article according to claim 1, wherein the passage extends laterally less than half way around the second sleeve.

3. The article as claimed in claim 1, wherein the passage has a constriction therein provided by an indentation in the first sleeve.

4. The article as claimed in claim 1, wherein the end of the second sleeve nearer to the solder abuts the solder.

5. The article as claimed in claim 1, wherein the solder is in the form of a ring.

6. The article as claimed in claim 1, wherein a portion of the solder is spaced from the first sleeve such that it provides a second passage in alignment with the first passage and wherein the second passage is capable of receiving a portion of the first substrate when the first substrate is protruding through the end of the first passage closer to the solder.

7. The article as claimed in claim 1, wherein the second sleeve is heat-shrinkable.

8. The article as claimed in claim 1, wherein part of the second sleeve is fusible at the temperature to which in use the article is heated to cause shrinking of the first sleeve and fusing of the solder.

9. An article as claimed in claim 1, wherein a quantity of fusible material is positioned in the region of the each end of the first sleeve.

10. An article as claimed in claim 9, wherein the quantity of fusible material is provided by the second sleeve.

11. An article as claimed in claim 1, wherein at least part of the first sleeve is resiliently deformable and is substantially rectangular in cross-section.

12. The article as claimed in claim 1 wherein first sleeve has at least one additional layer and wherein the second sleeve contacts the first sleeve through the additional layer(s).

13. The article as claimed in claim 12 wherein the additional layer(s) is an adhesive layer.

14. The article as claimed in claim 1, wherein the second sleeve is electrically insulating.

15. A method of connecting a first and a second electrical conductor which comprises the steps of:

inserting the first conductor into a nonannular, substantially empty passage of an article such that the first conductor is received and located by the passage;

the article comprising:

a first heat-recoverable sleeve having an inner surface;

a second sleeve, at least a part of which is of substantially infusible material disposed within the first sleeve, the second sleeve having an outer surface, a portion of the outer surface contacting a portion of the first sleeve inner surface, the remaining portions of the inner and outer surfaces of the first and second sleeves, respectively, defining a substantially nonannular, empty first passage which is a means for receiving and maintaining the location of the first conductor in the passage during heating;

a quantity of solder disposed within the first sleeve contacting a portion of the inner surface of the first sleeve and in the proximity of one end of the second sleeve;

stop means disposed within the first sleeve, formed at least in part by the solder for limiting penetration of the first conductor into the first passage; and the second sleeve infusible material being infusible at a temperature needed to cause the first sleeve to heat recover and the solder to melt;

positioning the first conductor in abutting relation to the stop means;

positioning the second conductor in the first sleeve but not in the passage and adjacent the solder; and heating the article until the solder melts and the first sleeve shrinks, thereby forming an electrical contact between the first and second conductors.

* * * * *